United States Patent [19]

Marshall et al.

[11] Patent Number: 4,497,697

[45] Date of Patent: Feb. 5, 1985

[54] ELECTROLYTIC PREPARATION OF 3,6-DICHLOROPICOLINIC ACID

[75] Inventors: Cary S. Marshall, Danville; Scott D. Troyer, Pittsburg, both of Calif.

[73] Assignee: The Dow Chemical Company, Midland, Mich.

[21] Appl. No.: 585,662

[22] Filed: Mar. 2, 1984

[51] Int. Cl.[3] ..... C25B 3/00

[52] U.S. Cl. ..... 204/73 R

[58] Field of Search ..... 204/73 R

[56] References Cited

U.S. PATENT DOCUMENTS 4,217,185 8/1980 Kyiacon ..... 204/73 R

*Primary Examiner*—John F. Niebling

*Attorney, Agent, or Firm*—Robert R. Stringham

[57] ABSTRACT

The rate of production of 3,6-dichloropicolinic acid by reduction of tetrachloropicolinic acid in basic aqueous solution in a given cell can be considerably increased if a trichloropicolinic acid is added to the tetrachloropicolinic acid feed in substantially greater proportions than can result from in-situ reduction of the tetrachloro acid. Preferably, the trichloro acid is obtained by acid hydrolysis of by-products of symmetrical tetrachloropyridine manufacture by chlorination/chlorinolysis of 6-chloro-2-(trichloromethyl)pyridine.

10 Claims, No Drawings

ELECTROLYTIC PREPARATION OF 3,6-DICHLOROPICOLINIC ACID

BACKGROUND OF THE INVENTION

According to U.S. Pat. No. 4,217,185, electrolytic reduction of tetrachloropicolinic acid ("tet-acid") in basic, aqueous solution at an activated silver cathode yields the 3,4,6- and 3,5,6-trichloropicolinic acids ("3,4,6-T" and "3,5,6-T") which in turn may be further reduced to 3,6-dichloropicolinic acid ("3,6-D"), a highly active herbicide. (The disclosure of the latter patent is incorporated herein by reference.)

In basic solution, it of course is the tetraand trichloropicolinate anions which actually are reduced (and 3,6-D is recovered as such by acidification of the reduction mixture). It is advantageous in several respects to be able to carry out a reduction of the disclosed type in the absence of organic solvents. However, the tet-acid is not very soluble in aqueous bases and the maximum attainable concentration of the corresponding picolinate anion is correspondingly low. The presence of any substantial amount of the undissolved tet-acid tends to result in particle aggregation and a type of foaming action (as a consequence of gas liberation at both electrodes). The latter difficulties can be largely avoided by adding the tet-acid incrementally during the initial stage of the reduction (together with an equivalent amount of base, dissolved in a minor portion of the reduction mixture). However, this does not have the effect of raising the concentration of the polychloropicolinate anions and the reduction rate is not increased.

It is apparent from the patent that either or both of the intermediate trichloro acids (if available other than by reduction of the tet-acid) could be considered as a starting material for 3,6-D production by the disclosed reduction process. However, it is not apparent that any increase in the production rate of 3,6-D would result. The inference may be drawn from the patent that the trichloro-acid is not significantly more base-soluble than the tet-acid. Having one less chlorine substituent than the tet-acid, the trichloro acids should be less chlorocarbon-like but would also be expected to be somewhat weaker acids; so it cannot be presumed on the basis of theoretical considerations that the tri-acids would be any more base-soluble.

It is also apparent that pre-formed mixtures of the tri- and tetrachloro acids—not necessarily in any ratio inherent in the disclosed stepwise reduction—could be employed as starting materials for 3,6-D production. The production of analagous acid—including 3,6-D itself, by acid hydrolysis of corresponding trichloromethylpyridines is known—as discussed below. Thus, if no hydrolysis of ring-chlorines occurred, acid hydrolysis of 3,4,6- and/or 3,5,6-trichloro-2-trichloromethylpyridine might be a feasible alternative route to the trichloro-acid intermediates. However, no substantial advantage over in-situ production of the latter acids from tet-acid is apparent. The amount of NaCl produced per pound of 3,6-D produced in the reduction process would be reduced but this could well be offset by the necessity of disposing of other by-products formed in the production of the trichloro-acids.

Furthermore, the prior art provides good reason for concern about the likelihood of ring-chlorine hydrolysis if production of the trichloro acids by hydrolysis is attempted. According to *McBee et al, Ind. Eng. Chem.,*

Vol. 39, page 389 (1947), the structures of 3,5-dichloro- and 3,4,5-trichloro-6-(trichloromethyl)pyridine were proven by "hydrolysis" to the corresponding trichloropicolinic acids. However, *Seyfferth, Journal fur Praktische Chemie,* Vol. 34, (1886) reported that hydrolysis of a "hexachloropicoline" (a trichloro, 2-trichloromethylpyridine, necessarily) gave a dichloro, hydroxypicolinic acid, rather than the trichloro acid; hydrolysis of a pentachloropicoline gave both the dichloro- and a hydroxy, monochloropicolinic acid.

There is also the consideration that the hexachloropicolines have only been available (by other than reduction) as components of not readily resolved mixtures of catalyst and by-products formed in the manufacture of symmetrical tetrachloropyridine ("sym-tet"). That is, U.S. Pat. No. 4,256,894—the disclosure of which is also incorporated herein by reference—discloses a process for production of symmetrical tetrachloropyridine ("sym-tet") by the chlorination/chlorinolysis of 2-chloro-6-(trichloromethyl)pyridine in the liquid state and in the presence of a Lewis acid catalyst, such as ferric chloride. Quite substantial amounts of other products form, even under optimum conditions, and must be separated from the sym-tet, as by distillation. Said other products include the 2,3- and 2,5-dichloro-6-(trichloromethyl)pyridines, the 2,3,4- and 2,3,5-trichloro-6-(trichloromethyl)pyridines, heptachloropicoline and pentachloropyridine. According to the patent, the reaction mixture is stripped of $CCl_4$, HCl and $Cl_2$ and then vacuum distilled to provide a first overhead cut comprising the sym-tet, the pentachloropyridine and some of the 2,3-dichloro-6-(trichloromethyl)pyridine and a second overhead cut comprising the rest of the latter compound and the 2,3,4- and 2,3,5-trichloro-6-(trichloromethyl)pyridines. The latter cut may be taken to include the heptachloropicoline (which is known to be hydrolyseable to tet-acid). However, $FeCl_3$ can be expected to co-distil, even if the "hepta" is not included in the cut. $FeCl_3$ is also quite soluble in polychloropicolines. Accordingly, $FeCl_3$ separation would be expected to be difficult. This is of no great consequence to sym-tet production, but is a deterrent as to attempting to utilize sym-tet by-products as a starting material for 3,6-D production.

Thus, neither the desirability or feasibility of utilizing sym-tet by-products as starting materials for the production of 3,6-D is made apparent by the prior art.

OBJECTS OF THE INVENTION

Broadly, the object of the present invention is to more efficiently utilize picoline (2-methyl pyridine) for the manufacture of useful products, such as sym-tet and 3,6-D.

A more specific object is to attain a higher pounds per hour output of 3,6-D per unit of electrolytic plant.

Another object is to utilize, as starting materials for 3,6-D production, by-products in the manufacture of sym-tet from 2-chloro-6-(trichloromethyl)pyridine by the method of the above-discussed 4,256,894 patent.

A corollary object is to sharply reduce the amount of sym-tet by-products which must be disposed of.

A further object is to increase the efficiency of production of 3,6-D by electrolytic reduction of more highly chlorinated picolinic acids.

Still other objects will be made apparent to those knowledgeable in the art by the following specifications and claims.

SUMMARY OF THE INVENTION

It has been discovered that the use of a tet-acid/trichloro acid mixture as a starting material for electrolytic production of 3,6-D permits attainment of the preceding objects. This is with the proviso that the tri- to tet-acid ratio in the starting material is higher than can be attained simply by in-situ reduction of tetrachloropicolinate anions under the same conditions; that is, under conditions in which the rate of further reduction of the resulting trichloropicolinates is comparable to the rate of formation of the latter species. (The 4,217,185 patent discloses attainment of "tri to tet" weight ratios as high as about 13:1, but only when employing NaOH contaminated with heavy metals—which reduce the activity of the silver cathode by plating out on it, thereby reducing the trichloro acid reduction rate to a considerably greater extent than the tet-acid reduction rate.)

The invention may be more precisely defined as an improvement in the process of preparing 3,6-D wherein tetrachloropicolinic acid in basic aqueous solution is electrolytically reduced to 3,5,6- and/or 3,4,6-trichloropicolinate anions under conditions such that said trichloro species are further reduced to 3,6-dichloropicolinate ions, said improvement comprising providing as said solution one which, in addition to the anions of said tetrachloro acid, contains said trichloro anions in a concentration greater than could have been achieved by reduction in-situ, under said conditions, of more of said tetrachloro anions.

Preferably, the acid(s) from which the additional trichloropicolinate anions are derived have been made by acid hydrolysis of 3,5,6- and/or 3,4,6-trichloro-2-(trichloromethyl)pyridine produced as by-products in the preparation of 1,2,5,6-tetrachloropyridine from 2-chloro-6-(trichloromethyl)pyridine.

DETAILED DESCRIPTION

The improved process of the present invention is practiced essentially in the manner of the basic process disclosed in U.S. Pat. No. 4,217,185.

The preferred cathode for the practice of the improved process is the silver cathode described in the latter patent (and, in greater detail, in U.S. Pat. No. 4,242,183). However, any cathode may be employed at which 3,6-dichloropicolinate anions can be produced by the electrolytic reduction of tetrachloropicolinic acid in basic, aqueous solution.

Similarly, any otherwise suitable anode which does not act as a source of intolerable amounts of cathode-deactivating cations may be employed in the practice of the present invention.

Feeds to the Reduction

Mixtures of tetra- and trichloropicolinic acids suitable as starting materials for the improved process are those in which the content of 3,5,6- and/or 3,4,6-T is such as to provide the corresponding trichloroanions in a concentration higher than can be attained by reduction of tetrachloropicolinate anions under conditions such that further reduction of the trichloro species is favored. The latter trichloro-ion content may vary somewhat according to the reaction conditions, the activity of the cathode, etc., but can readily be determined with the guidance provided in the 4,217,185 patent. However, this will usually be unnecessary. As a general rule, the concentration of in-situ-produced sodium trichloropicolinate anions ordinarily will not exceed that corresponding to about 2.6 wt. % of sodium trichloropicolinate. That is, if sodium tetrachloropicolinate is reduced by carrying out the process of the 4,217,185 patent as a batch operation, the weight percents of sodium di-, tri- and tetrachloropicolinic acids in the reaction mixture typically vary with run duration about as follows.

TABLE 1

| Elapsed Time | Percents by Weight | | |
|---|---|---|---|
| Hours | Tri- | Tet- | 3,6-D |
| 0 | 0 | 0 | 0 |
| 1.2 | 0.679 | 0.188 | 0.493 |
| 2.0 | 1.336 | 0.455 | 1.433 |
| 5.0 | 2.581 | 0.028 | 4.276 |
| 7.7 | 0.862 | nil | 5.846 |
| 9.2 | 0.187 | — | 6.232 |
| 10.2 | 0.007 | — | 6.660 |
| 11.5 | nil | — | 6.682 |

$6.682 \times 213.994/192.012 = 7.45$ wt. % 3,6-D salt

Trichloropicolinate contents somewhat higher than 2.6 wt. % may be attained by in-situ reduction of tet-acid salt when the content of the latter is maximized by maintaining an excess of the free, solid acid in contact with the reaction solution.

The latter expedient may be resorted to—despite the aforementioned foaming problem—when it is desired to maximize the content of 3,6-D in the process effluent. The latter content is limited by the depressing effect of increasing NaCl contents on 3,6-D solubility. When the tet-acid is the starting material for the reduction, the practical limit on 3,6-D content is from about 8 to 9 wt. %. However, as the proportion of trichloro acid(s) in the feed to the reaction goes up, the amount of NaCl generated in forming a given amount of 3,6-D salt goes down. Thus, when the tri- to tet-weight ratio in the feed is about 9:1, a final 3,6-D salt (the sodium salt, that is) content of about 16 wt. % should be attainable without having to cope with the presence of free acid particles.

The feed to the reduction, in addition to the tri- and tetrachloroacids, may include any other material which—in the amount present—does not detrimentally affect the process to an intolerable extent. Such other materials include, for example, the sodium salt of 3,6-D itself.

Similarly, the base employed, though preferably NaOH, may be any otherwise suitable base—such as KOH, for example, in which the solubility of 3,5,6- and/or 3,4,6-trichloropicolinic acid is greater than the solubility therein of tetrachloropicolinic acid.

The tri- and tetrachloropicolinate solution may be formed in any convenient manner. For example, the acids may be co-dissolved in an aqueous base or may be dissolved in separate portions of the base and then combined. Alternatively, the trichloro acid or its salt may be added to a basic aqueous solution resulting from partial reduction of a tetrachloropicolinate solution.

The relative amounts of the tri- and tet-acids must be such as to provide a higher tri-salt content than can be attained simply by reduction in-situ of the tet-acid salt. On the other hand, the solubility of the tet-salt decreases as the content of the more soluble tri-salt goes up, so there are practical limits on tri-content in a process utilizing the tet-acid in the production of 3,6-D.

Relative Solubilities

Table 2 following shows the depressing effects of extra sodium ion content on the solubilities of the tri- and tetrachloropicolinates (determined in separate solutions).

TABLE 2

| Extra[1] $Na^+$ Content Gram Ions/Liter | Picolinate Solubility, g. moles/liter Tri- | Tet- |
|---|---|---|
| 0.0 | 0.660 | 0.260 |
| 0.2 | 0.555 | 0.180 |
| 0.4 | 0.455 | 0.125 |
| 0.6 | 0.365 | 0.084 |
| 0.8 | 0.300 | 0.060 |
| 1.0 | 0.246 | 0.050 |
| 1.2 | 0.200 | ND[2] |
| 1.4 | 0.164 | ND |

NOTE:
[1]Sum of $Na^+$ from NaCl & NaOH contents; does not include $Na^+$ present as picolinate.
[2]Not Determined.

Current Densities

Within the range of cathode potential (vs. a standard reference electrode) of from about −1.0 to about −1.4 volts, semi-log plots of current density vs. cathode potential at successively higher picolinate contents are essentially linear and parallel. Table 3 following gives approximate current densities at cathode potentials of −1.05, −1.2 and −1.35 volts at each of four successively higher tet-salt contents. Current densities are also given for as many as six successively higher tri-salt contents.

(Onset of copius $H_2$ evolution occurs at about −1.37 to −1.4 volts cathode potential.)

TABLE 3

| Wt. % of Picolinate | Cathode Current Density (Amps/in²)[1] Trichloropicolinate[2] Cathode Potential −1.05 v | −1.2 v | −1.35 v | Tetrachloropicolinate Cathode Potential −1.05 v | −1.2 v | −1.35 v |
|---|---|---|---|---|---|---|
| 0.5 | — | — | 0.058 | 0.092 | 0.128 | 0.195 |
| 1.0 | — | — | 0.116 | 0.170 | 0.248 | 0.360 |
| 2.0 | — | 0.074 | 0.250 | 0.343 | 0.485 | 0.695 |
| 4.0 | — | 0.144 | 0.520 | 0.730 | 1.060 | 1.515 |
| 6.0 | — | 0.207 | 0.720 | — | — | — |
| 8.0 | 0.09 | 0.310 | 1.040 | — | — | — |

Note:
[1]Current per unit area of geometric surface of cathode.
[2]3,5,6-T.

It will be seen that the current density attainable at a given cathode potential is considerably lower for the trichloropicolinate than for the tetrachloropicolinate. The former is more soluble than the latter but also "takes up" only half as many electrons in being reduced to 3,6-D salt.

Sources of 3,5,6- and/or 3,4,6-Trichloropicolinic Acids 3,5,6- and/or 3,4,6-trichloropicolinic acids (as such or as salts with bases) from any source whatever (other than by electrolytic reduction of tetrachloropicolinic acid) may be employed in the practice of the present invention. Preferably, the trichloro acid or acids are by-products of sym-tet manufacture by the process of the 4,256,894 patent.

The components of typical sym-tet reaction mixtures of direct interest to the practice of the present invention are heptachloropicoline ("hepta") and the hexachloropicolines ("3,5,6-hexa", predominantly). The most practical way of separating these components from the rest of the reaction mixture is distillation. It is not necessary to separate said components from each other. The distillation cuts containing them may also include some 3,6-dichloro-2-trichloromethylpyridine ("3,6-penta"), although this may lead to somewhat higher monochloropicolinic acid contents in the final product.

The more volatile components of the sym-tet reaction mixture—including the sym-tet, the "3,6-" and "5,6-pentas" and pentachloropyridine—may be distilled off under vacuum at pot temperatures up to about 157° C. at 40 mmHg. The "hexas" and "hepta" can be separated from the tars and most of the $FeCl_3$ catalyst by flash distillation at pot temperatures up to 190° C. at 10 mmHg. Typically, the overheads from the flash distillation include the 3,5,6-hexa, 3,4,6-hexa and hepta in proportions by weight of about 86 to 2 to 12, respectively, and may include as much as 100 ppm of iron. More complete separation from the $FeCl_3$ can be achieved by distillation through a column under reflux, as below.

If desired, a considerably lower iron content in the material to be distilled can be achieved by methods such as intimately contacting the crude reaction product, as such or dissolved in a water-immiscible solvent, with dilute aq. HCl.

Table 4 following gives the data for distillation of an acid-washed, low sym-tet content mixture of chloropicolines through a 5-plate Oldershaw column at a reflux ratio of 10:1 and at a nominal pressure of 0.5 mmHg. The proportions by weight of the several components of the mixture were as follows: sym-tet, 7.6; pentachloropyridine, 4.4; 5,6-penta, 0.9; 3,6-penta, 0.004; hexas, 72.8; and hepta, 9.3; hexas to hepta ratio=7.83. Ten overhead cuts were taken.

TABLE 4

| DISTILLATION OF MIXED CHLOROPICOLINES | 1 | 2 | 3 | 4 | 5 | 6 | 7 | 8 | 9 | 10 |
|---|---|---|---|---|---|---|---|---|---|---|
| Weight[3] | Total for cuts 1–4: 350.4 | | | | | 60.4 | 81.8 | 100.9 | 140.5 | 132.1 |
| Final Pot Temp. | 170 | 170 | 175 | 175 | 170 | 170 | 170 | 170 | 170 | 170 |
| Final Head Temp. | 113 | 119 | 149 | 149 | 141 | 134 | 130 | 132 | 128 | 128 |
| Composition[1] | 94.9 | 74.4 | 12.5 | 1.0 | 0.5 | — | — | — | — | — |
| Sym-tet | | | | | | | | | | |
| Pentachloro Pyridine | 3.8 | 16.7 | 31.3 | 15.1 | 7.5 | 0.9 | 0.11 | — | — | — |
| 5,6-Penta | 0.28 | 1.7 | 6.8 | 5.8 | 4.2 | 1.5 | 0.32 | 0.07 | — | — |
| 3,6-Penta | — | 0.2 | 0.9 | 0.9 | 0.8 | 0.4 | 0.13 | — | — | — |
| 4,5,6-Hexa | — | 0.08 | 0.5 | 0.6 | 0.7 | 0.6 | 0.45 | 0.32 | 0.16 | — |
| 3,5,6-Hexa | — | 6.7 | 46.6 | 74.9 | 84.8 | 94.9 | 96.7 | 96.5 | 93.1 | 71.2 |

TABLE 4-continued

| | DISTILLATION OF MIXED CHLOROPICOLINES | | | | | | | | | |
|---|---|---|---|---|---|---|---|---|---|---|
| | 1 | 2 | 3 | 4 | 5 | 6 | 7 | 8 | 9 | 10 |
| Hepta | — | 0.09 | 0.5 | 0.8 | 0.8 | 1.2 | 2.1 | 2.9 | 6.7 | 28.8 |

Notes:
[1]Area % by GC (Gas Chromatography).
[2]Actual pressure varied around value somewhat greater than nominal pressure during distillation of cuts 1–6, probably due to HCl evolution.
[3]Total weight of overheads 965.4 grams.

Acid Hydrolysis

Chloropicoline mixtures enriched in hexa and hepta, separated from sym-tet reaction mixtures (or otherwise provided) may be efficiently hydrolyzed by stirring them with 90% aq. $H_2SO_4$ at 120° C. for about 15 to 20 minutes. The resulting polychloropicolinic acids (3,5,6-T and tet-acid, predominantly) can be recovered by precipitation with water, filtration, extraction of filtrate and stripping of the resultant extract.

The precipitation is accomplished by dilution of the cooled reaction mixture, preferably to a final acid content of 25 weight % and preferably by careful addition of water to the stirring mixture, at a rate such that, with the cooling available, the temperature does not exceed 110° C. The filtrate is extracted with a solvent such as $CH_2Cl_2$ or $CHCl_3$, in the conventional manner. If desired, the extract may be concentrated and/or chilled, and filtered, before or instead of being stripped. The hydrolysis product recovered from the extract will generally be substantially less pure than that obtained as the initial filtrand (the precipitated product), since the less highly chlorinated components of the reaction mixture are more soluble in both the diluted acid and the extraction solvent.

EXAMPLES

The following examples are for purposes of illustration and are not to be construed as limiting the present invention in a manner inconsistent with the claims appended to these specifications.

The hydrolysis described in Example A is not, by itself, an example of the present invention. However, the overall process which comprises hydrolysis and electrolytic reduction of the hydrolysis product is a preferred embodiment of the invention.

EXAMPLE A

Acid hydrolysis of hexa/hepta-rich chloropicoline mixtures.

Cuts 8, 9 and 10 (Table 4, preceding) were each reanalyzed, hydrolyzed and worked up as above. The hexa and hepta contents (in weight percents) of the cuts, the hydrolysis time and the yields and compositions of the hydrolysis products recovered by precipitation and extraction are given in Table 5 following. In each hydrolysis, the acid (90% $H_2SO_4$) was employed in a 2:1 weight ratio with the chloropicoline mixture and the temperature was 120° C.

TABLE 5

| | | | | Product Distribution, wt. %[3] | | | | | | | |
|---|---|---|---|---|---|---|---|---|---|---|---|
| | | | | Precipitated Product | | | | Solvent Extracted Product | | | |
| Cut No. | Wt. % Hexa[1] | Wt. % Hepta[2] | Hydrolysis Time (Hours) | 356-TCPA Yield (%) | 356-TCPA Purity (Wt. %) | 356-TCMP (Wt. %) | Tet Acid (wt. 5) | 356-TCPA Yield (%) | 356-TCPA Purity (Wt. %) | 356-TCMP (Wt. %) | Tet Acid (Wt. %) |
| 8 | 94.9 | 2.5 | 0.25 | 96.0 | 98.3 | — | — | 3.9 | 74.6 | 3.4 | 8.8 |
| 9 | 88.6 | 7.0 | 0.25 | 96.7 | 92.5 | — | 3.4 | 5.6 | 80.5 | — | 13.6 |
| 10 | 64.0 | 31.0 | 0.33 | 97.1 | 65.3 | — | 28.5 | 5.2 | 76.5 | — | 16.5 |

NOTES:
[1]3,5,6-Trichloro-2-trichloromethylpyridine.
[2]Heptachloropicoline.
[3]356-TCPA = 3,5,6-trichloropicolinic acid.
356-TCMP = 3,5,6-trichloro-2-trichloromethylpyridine.
Tet Acid = 3,4,5,6-tetrachloropicolinic acid.
[4]Combined purity = purity resulting from combining the precipitated and solvent extracted product.

EXAMPLE 1

Reduction of 3,5,6-T/tet acid mixture

A mixture of 3,5,6-trichloro picolinic acid (tri acid) and tetrachloropicolinic acid (tet acid) was electrolyzed in a flow-through cell. The electrodes were 2.5 cm × 7.5 cm flat planar electrodes separated 0.31 cm. A solution of the mixture in aqueous NaOH was cycled through the slot formed between the electrodes at a temperature of about 22° C. and at a rate of 750 ml/minute.

316 Stainless steel plate was used as the anode, where the primary reaction was the generation of oxygen from the electrolysis of sodium hydroxide. The cathode consisted of an expanded silver mesh and was activated several times during the run by reversing the current for three minutes each time at a current density of 0.032 amps/cm$^2$. The primary reaction at the cathode was the removal of chlorine (as $Cl^-$) from the 3,5,6-T and tet-acid with the final product being 3,6-dichloro picolinic acid.

The starting solution contained:
130 ml $H_2O$
8.8 g Trichloro picolinic acid
0.8 g Tetrachloro picolinic acid
4.6 g NaOH.

For the first 2 hours and 37 minutes of the run, fresh tri- and tet-acid solids, $H_2O$ and NaOH were added to the circulating solution.

These materials were added (according to the number of coulombs that had passed through the electrolyte (solution)) in amounts calculated to replace the tri-acid electrolyzed. The sodium hydroxide was added to maintain the free NaOH content of the electrolyte at 2 weight %, making up for the sodium hydroxide consumed at the anode and in neutralizing the tri- and tet-acid added. The materials to add were calculated as follows:

$H_2O$ 0.0035×coulombs

Tri acid 0.00098×coulombs

Tet acid 0.000098×coulombs

NaOH 0.00038×coulombs.

A history of the run is given in Table I and the analytical results obtained from samples taken during the run in Table II. From the analyses, it is obvious that the run was complete after 12 hours.

TABLE I

| Time Since Current Turned On | Total Coulombs Passed | $H_2O$ Added Grams | NaOH Added Grams | Tri Acid Added Grams | Tet Acid Added Grams |
|---|---|---|---|---|---|
| 0 | 0 | | Sample #1 (Table II) | | |
| 5 min[1] | | | | | |
| 30 min | 2518 | 8.88 | .96 | 2.47 | .25 |
| 1 hr[1] | | | | | |
| 1 hr 10 min | 5604 | 10.8 | 1.17 | 3.02 | .30 |
| 1 hr 25 min | | | Sample #2 (Table II) | | |
| 1 hr 30 min | 7954 | 6.1 | 1.56 | 1.72 | .17 |
| 1 hr 45 min[1] | | | | | |
| 2 hrs 2 min | 9858 | 8.8 | .95 | 2.45 | .25 |
| 2 hrs 20 min[1] | | | | | |
| 2 hrs 37 min | 12,629 | 9.7 | 1.05 | 2.71 | .27 |
| 3 hrs 30 min[1] | | | | | |
| 3 hrs 40 min | | | Sample #3 (Table II) | | |
| 4 hrs 5 min | 18,676 | 5 | 2.29 | — | — |
| 5 hrs 10 min | 21,766 | | Sample #4 (Table II) | | |
| 5 hrs 20 min[1] | | | | | |
| 7 hrs | 25,000 | | Sample #5 (Table II) | | |
| 7 hrs 10 min[1] | | | | | |
| 8 hrs 35 min | 27,176 | | Sample #6 (Table II) | | |
| 10 hrs 35 min | 28,882 | | Sample #7 (Table II) | | |
| 11 hrs 5 min[1] | | | | | |
| 12 hrs 5 min | 30,293 | | Sample #8 (Table II) | | |
| 13 hrs 5 min | 31,963 | | Sample #9 (Table II) | | |
| 14 hrs 5 min | 32,497 | | Sample #10 (Table II) | | |
| 15 hrs 10 min | off | | | | |

NOTES:
[1]Anodized.

TABLE II

| | LC[1] Analysis of Electrolyte During Run | | |
|---|---|---|---|
| Sample No. | 3,6-Dichloro Picolinic Acid gpl[2] | 3,5,6-Trichloro Picolinic Acid gpl | Tetrachloro Picolinic Acid gpl |
| 1 | 0 | 67.7 | 6.2 |
| 2 | 34.7 | 68.0 | 1.6 |
| 3 | 70.5 | 60.4 | .5 |
| 4 | 84.7 | 33.5 | 0 |
| 5 | 94.7 | 18.3 | 0 |
| 6 | 98.4 | 11.3 | 0 |
| 7 | 103.7 | 7.2 | 0 |
| 8 | 106.9 | 3.4 | 0 |
| 9 | 107.0 | 2.5 | 0 |
| 10 | 106.4[3] | 2.4 | 0 |

NOTE:
[1]Liquid chromatography.
[2]Grams per liter (equal to wt. % × 10, since density of solution is close to 1.0).
[3]Final wt. % of the Na salt of 3,6-D = 10.64 × 213.994/192.012 = 11.85 wt. %.

It will be seen that the final content of the 3,6-D sodium salt was considerably higher than that (about 7 weight %) attainable when utilizing tet-acid alone as the starting material (under really practical conditions, i.e., conditions which do not result in foaming).

EXAMPLE B

Comparison of relative 3,6-D production rates when using 3,5,6-T (and/or 3,4,6-T) and tet acid feeds.

Not an example of the invention per se.

To demonstrate the greater production efficiency attainable by using feeds containing high proportions of the trichloro acids, separate "high-tri" and tet-acid runs were computer simulated. The high tri-run was computed for a 100% tri-feed (no tet-acid included, in other words), to simplify the computer programming chore. The tet-acid run closely corresponded with actual plant scale practice of the process of the 4,217,185 patent. The differences in the two runs were essentially those due to the inherent differences in solubility and reactivity between the two feed acids.

Enough of the acid is added to the aqueous caustic (in the amounts given below) to bring the solution to saturation. The cell current is obtained with the aid of plots of the data in Tables 2 and 3 herein, with the cathode potential "set" at −1.3 volts. The amount of chloro picolinic acid which would have been electrolyzed after ½ hour is calculated, and the amount of 50% caustic and either 12% tetrachloropicolinic acid which must be added is calculated to bring the electrolyte back to a 2% caustic content and to saturation with respect to the organic acid. The calculation is repeated for ½ hour intervals for a total of 10 hours. Then addition of the organic acid is "stopped", and a calculation is made of the length of time required to continue electrolysis until 98% of the starting acid is converted to the sodium salt of 3,6-D. The results are tabulated in Tables III and IV following.

The electrolysis with tri-acid takes longer (25½ hours compared to 15½ hours for the tet); however, so much more feed can be processed per run that the rate of production of the 3,6-D salt is nearly twice as great (the equivalent rates of 3,6-D production are about 23#/hour for the tri-, vs. ~12#/hour for the tet).

The runs are assumed to be carried out as follows. A prototype, production-scale cell is set up with a total of five parallel-connected, 4′×11″ silver screen cathodes, supported by inert, composite backboards. The total nominal cathode area (counting both sides of the silver screens) is $4\times11/12\times2\times5=36.7$ ft$^2$. The cathodes are washed with aqueous HCl, rinsed with reverse-osmosis purified water and activated by anodization in a total of 1000 lbs. of a solution of 88 lbs. of tri-acid or 25 lbs. of tet-acid in 2.3% aqueous solution of NaOH at +0.6 volts (relative to SCE*) for 1/6 hour. The solution is circulated, by means of a centrifugal pump, from the cell to a mixing tank and back, and passed from a flow distributor through the spaces (¼″ spacing) between the cathodes and (six) counter electrodes of the same shape and area as the cathodes. Additional tri- or tet-acid is charged to the reaction by incremental addition to the mixing tank as noted in Tables III and IV. The reduction is discontinued after the total time noted in the Table and the reaction mixture is worked up.

*Saturated calomel electrode

TABLE III

COMPUTER SIMULATED PLANT-SCALE ELECTROLYSIS OF TRI-ACID

| Elapsed Time | Pounds Tri-Acid Added | | Cumulative Total Weight of Reaction Solution | Pounds NaOH Solution per se Added | | Cell Current | Lbs. NaOH Added with | Cl— Content |
|---|---|---|---|---|---|---|---|---|
| Hours | Increment | Total | Lbs. | Increment | Total | Amps | Acid | Wt. % |
| 0 | 88 | 88 | 1000 | 40 | 40 | 7904 | — | 0 |
| 0.5 | 43.2 | 131.2 | 1216 | 20 | 60 | 6924 | 8.0 | 0.9 |
| 6.0 | 27.3 | 158.5 | 2830 | 12.4 | 209.2 | 4971 | 6.1 | 2.67 |
| 10.0 | 26.0 | 665.0 | 3890 | 11.8 | 305.2 | 4732 | 5.9 | 3.02 |
| 10.5 | 25.9 | 690.9 | 4020 | — | — | 4712 | 3.5 | — |
| 11.0 | 0 | 690.9 | 4027 | 7.0 | 330.0 | 4277 | 3.2 | — |
| 17.3 | 0 | 690.9 | 4076 | — | — | 1239 | 0.9 | — |
| 23.5 | 0 | 690.9 | 4076 | — | — | 401 | — | — |
| 25.5 | 0 | 690.9 | 4092 | 0.45 | 389.0 | 276 | — | 4.21 |

Final unconverted tri-acid content 12.9 lbs.

Wt. % Na salt of 3,6-D present = $(690.9 - 12.9) \times \frac{213.994}{226.464} \times \frac{100}{4092} = 15.656$ wt. %

(assuming 100% yield based on conversion).

Average 3,6-D salt production rate = $\frac{0.1565 \times 4092}{25.5}$ 25.11 × lbs. hr.

TABLE IV

COMPUTER SIMULATED PLANT-SCALE ELECTROLYSIS OF TET-ACID

| Elapsed Time | Pounds Tet-Acid Added | | Cumulative Total Weight of Reaction Solution | Total Pounds NaOH Solution per se | Cell Current | Lbs. NaOH Added with | Cl— Content |
|---|---|---|---|---|---|---|---|
| Hours | Increment | Total | Lbs. | Added | Amps | Acid | Wt. % |
| 0 | 25.0 | 25.0 | 1000 | 40 | — | — | 0 |
| 0.5 | 20.4 | 45.4 | 1188 | 58.4 | 7216 | 8.38 | 0.9 |
| 6.0 | 10.1 | 55.5 | 2452 | 185 | 3896 | 4.60 | 2.78 |
| 10.0 | 9.0 | 257.0 | 3148 | 192 | 3472 | 4.10 | 3.17 |
| 10.5 | 8.9 | 265.9 | 3230 | 264 | 3737 | 2.50 | — |
| 14.5 | 0 | 265.9 | 3250 | 283 | 576 | — | — |
| 15.5 | 0 | 265.9 | 3250 | 283 | 148 | — | 3.56 |
| 17.0 | 0 | 265.9 | 3250 | 283 | 103 | — | — |

Final content of unconverted (tri-acid) = 3.8 lbs.

Wt. % Na Salt of 3,6-D present = $\frac{\left(265.9 - \frac{261.446}{226.994} \times 3.8\right) \times \frac{213.994}{260.916} \times 100}{3235} = 6.630$ wt. %.

Assuming all tet-acid charged converted either to tri-acid or 3,6-D.

Average 3,6-D salt production rate = $\frac{0.0663 \times 3235}{17} = 12.578$ lbs./hr.

What is claimed is:

1. An improvement in the process of preparing 3,6-dichloropicolinic acid wherein tetrachloropicolinic acid in basic aqueous solution is electrolytically reduced to 3,5,6- and/or 3,4,6-trichloropicolinate anions under conditions such that said trichloro species are further reduced to 3,6-dichloropicolinate anions, said improvement comprising providing as said solution one which, in addition to the anions of said tetrachloroacid, contains said trichloro anions in a concentration greater than could have been achieved by reduction in-situ, under said conditions, of more of said tetrachloro anions.

2. The improved process of claim 1 wherein said base is NaOH.

3. The improved process of claim 1 wherein said reduction is effected at a silver cathode.

4. The improved process of claim 1 wherein at least some of the trichloropicolinic acids dissolved in said solution have been produced by the chlorination/-chlorinolysis of 2-chloro-6-(trichloromethyl)pyridine in the liquid state in the presence of a Lewis acid catalyst.

5. The process of claim 2 wherein said reduction is effected at a silver cathode.

6. The process of claim 4 wherein said reduction is effected at a silver cathode.

7. The process of claim 6 wherein said base is NaOH.

8. The process of claim 1 wherein the weight ratio of said trichloro- to tetrachloropicolinates in said solution is about 9:1 or more.

9. The process of claim 5 wherein the weight ratio of said trichloro- to tetrachloropicolinates in said solution is about 9:1 or more.

10. The process of claim 7 wherein the weight ratio of said trichloro- to tetrachloropicolinates is about 9:1 or more.

* * * * *